US007561710B2

(12) United States Patent
Frederiksen

(10) Patent No.: US 7,561,710 B2
(45) Date of Patent: Jul. 14, 2009

(54) COMMUNICATION DEVICE WITH MICROPHONE

(75) Inventor: Peter Frederiksen, Smørum (DK)

(73) Assignee: Oticon A/S, Smørum (DK)

( * ) Notice: Subject to any disclaimer, the term of this patent is extended or adjusted under 35 U.S.C. 154(b) by 180 days.

(21) Appl. No.: 10/581,598

(22) PCT Filed: Nov. 22, 2004

(86) PCT No.: PCT/DK2004/000809

§ 371 (c)(1),
(2), (4) Date: Jul. 5, 2006

(87) PCT Pub. No.: WO2005/055655

PCT Pub. Date: Jun. 16, 2005

(65) Prior Publication Data

US 2007/0030991 A1 Feb. 8, 2007

(30) Foreign Application Priority Data

Dec. 5, 2003 (DK) ..... 2003 01802

(51) Int. Cl.
*H04R 25/00* (2006.01)

(52) U.S. Cl. ..... 381/322; 381/312; 381/324; 381/330

(58) Field of Classification Search ..... 381/313, 381/322, 324, 330, 357, 361, 381
See application file for complete search history.

(56) References Cited

U.S. PATENT DOCUMENTS

| | | | | |
|---|---|---|---|---|
| 3,101,155 | A | 8/1963 | Lehr et al. | |
| 3,123,678 | A * | 3/1964 | Prentiss | 381/330 |
| 3,239,093 | A * | 3/1966 | Gath | 220/4.02 |
| 3,359,377 | A | 12/1967 | Rosenstand | |
| 3,458,668 | A * | 7/1969 | Hassler | 381/313 |
| 3,836,732 | A * | 9/1974 | Johanson et al. | 381/313 |
| 5,708,720 | A * | 1/1998 | Meyer | 381/322 |
| 6,324,291 | B1 * | 11/2001 | Weidner | 381/322 |
| 6,724,903 | B2 * | 4/2004 | Niederdrank | 381/330 |
| 7,174,028 | B1 * | 2/2007 | Niccolai | 381/322 |

FOREIGN PATENT DOCUMENTS

| | | |
|---|---|---|
| DE | 1153797 | 9/1963 |
| WO | 0002419 | 1/2000 |
| WO | 0021334 | 4/2000 |
| WO | 0074915 | 12/2000 |

* cited by examiner

*Primary Examiner*—Suhan Ni
*Assistant Examiner*—Ryan C Robinson
(74) *Attorney, Agent, or Firm*—Dykema Gossett PLLC

(57) ABSTRACT

The invention concerns a communication device with a casing enclosing a microphone and signal processor, whereby the casing comprises at least a first and a second part and a packing material provided between the first and the second part, and whereby further the microphone orifice is provided between the first and the second part and interrupting the packing material.

3 Claims, 5 Drawing Sheets

COMMUNICATION DEVICE WITH MICROPHONE

AREA OF THE INVENTION

The invention concerns a head worn communication device with at least one microphone. In modem communication devices like hearing aids or head sets a microphone is often placed inside a casing, which is associated with the ear of the user of the communication device.

BACKGROUND OF THE INVENTION

The microphone inside the casing usually has access to the surrounding air through a canal and an orifice in the casing of the communication device. If a sound tight fit between the orifice in the casing and the canal is not provided, there is a risk that sounds provided to the ear from a possible sound generating device in the casing may leek into the microphone canal and cause feed back problems. Further, an air and fluid tight fit between the orifice in the casing and the canal is advantageous, as this helps to prevent foreign substances such as sweat, salt or dust from entering or migrating into the casing, where such substances would harm the delicate electronic components of the device. In head worn communication devices it is also desired that the microphone opening in the casing should be as in inconspicuous as possible in order not to draw unnecessary attention to the device.

SUMMARY OF THE INVENTION

It is an object of the invention to provide a head worn communication device wherein a tight seal is provided between the casing and the microphone orifice, while at the same time the microphone orifices remains inconspicuous.

In accordance with the invention the sound input orifice for the microphone is placed in the packing means between the first and second part of the casing to provide a tight seal between the casing and the sound canal. This placement of the microphone orifice makes the orifice particularly inconspicuous. The microphone orifice interrupts the packing means either completely or only partially. Either way, a tight seal between the microphone orifices and the surrounding shell material is easily achieved. By the term "packing means " is to be understood any gasket or gasket material which will help to provide an air and fluid tight seal between two elements.

In a preferred embodiment of the invention two orifices are provided for each microphone, such that an orifice to each microphone may be placed at two opposed sides of the device. In this way a symmetric apparatus may be provided, which is usable on both the left and the right ear. Further, the microphone orifice to each side will prevent problems caused by clogging of the sound passage to the microphone as such clogging would have to affect both orifices in order to entirely prevent the hearing aid from working.

DESCRIPTION OF A PREFERRED EMBODIMENT

Figure 1:
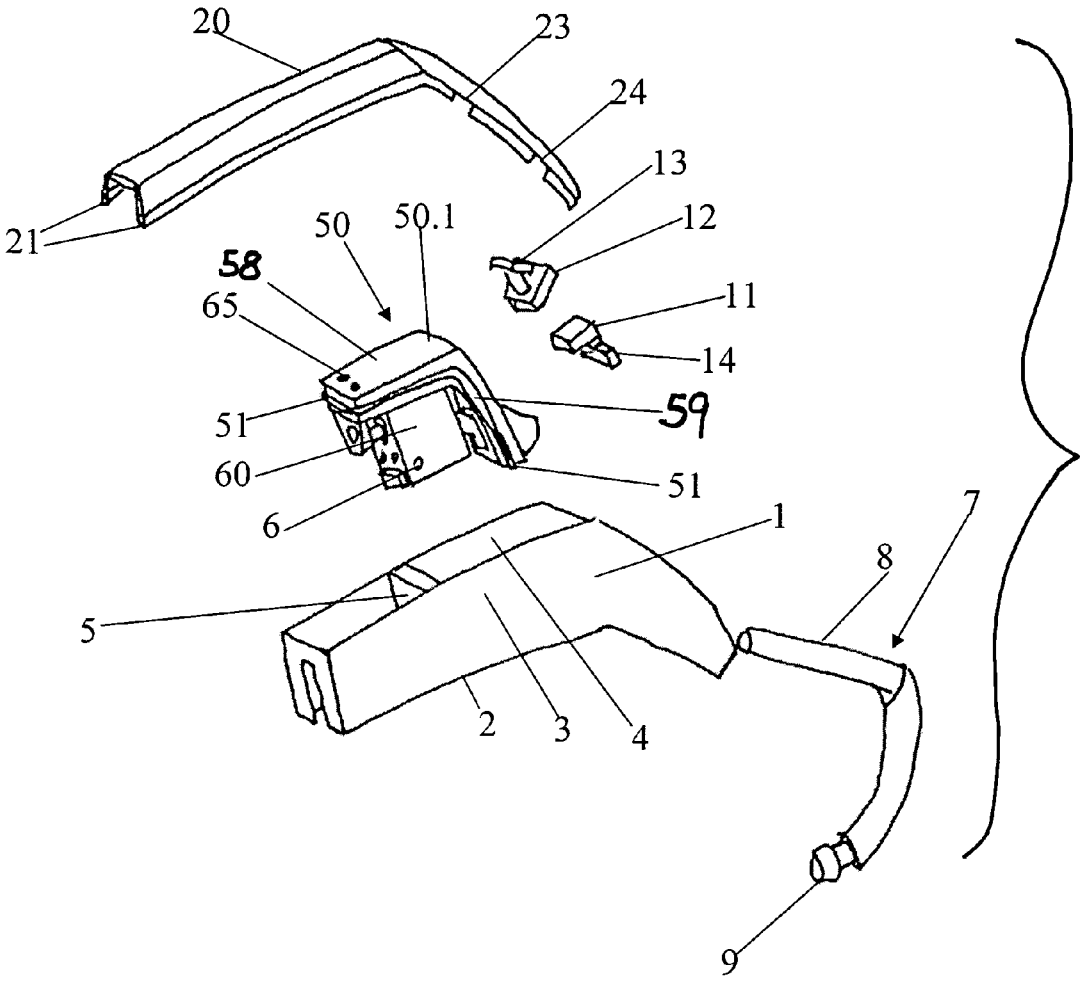
FIG. 1 shows an exploded view of a communication device according to the invention.
Figure 1A:
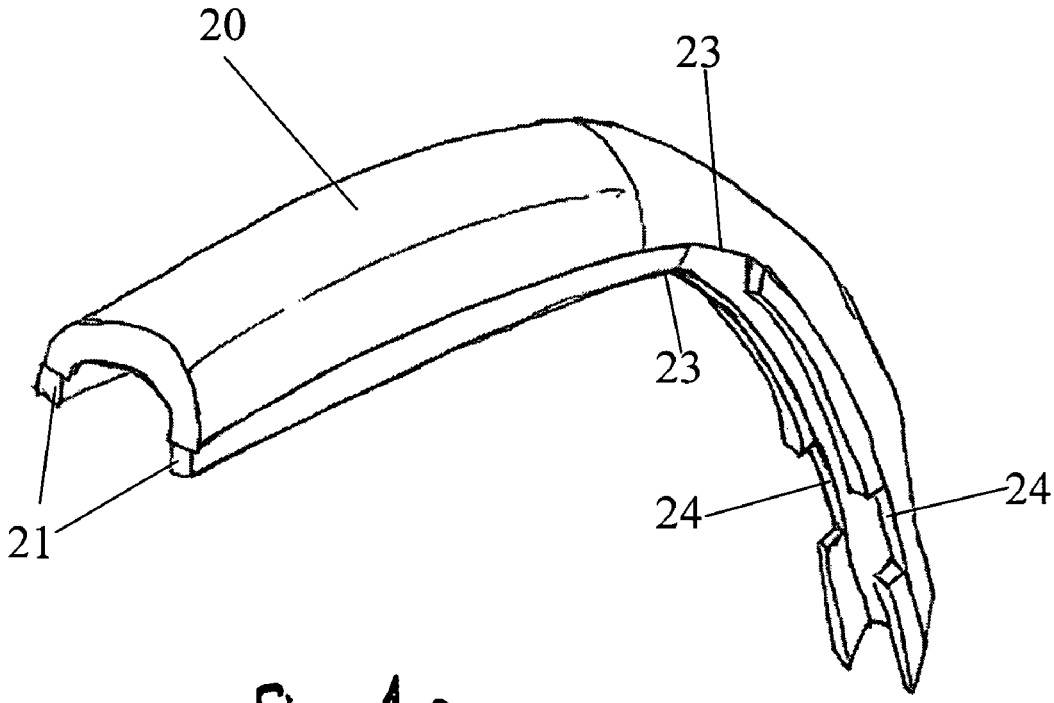
FIG. 1*a* shows a perspective view of the top shell.

The exploded view of FIG. 1 displays the various parts of the hearing aid. The hearing aid comprises a bottom shell 1 and a top shell 20. When assembled the bottom shell 1 and the top shell 20 enclose a receiver assembly 50 and the microphones 11, 12. A hook 7 is insertable into the bottom shell 1 in order to provide a sound guide from the receiver 60 to the surroundings.

Figure 2:
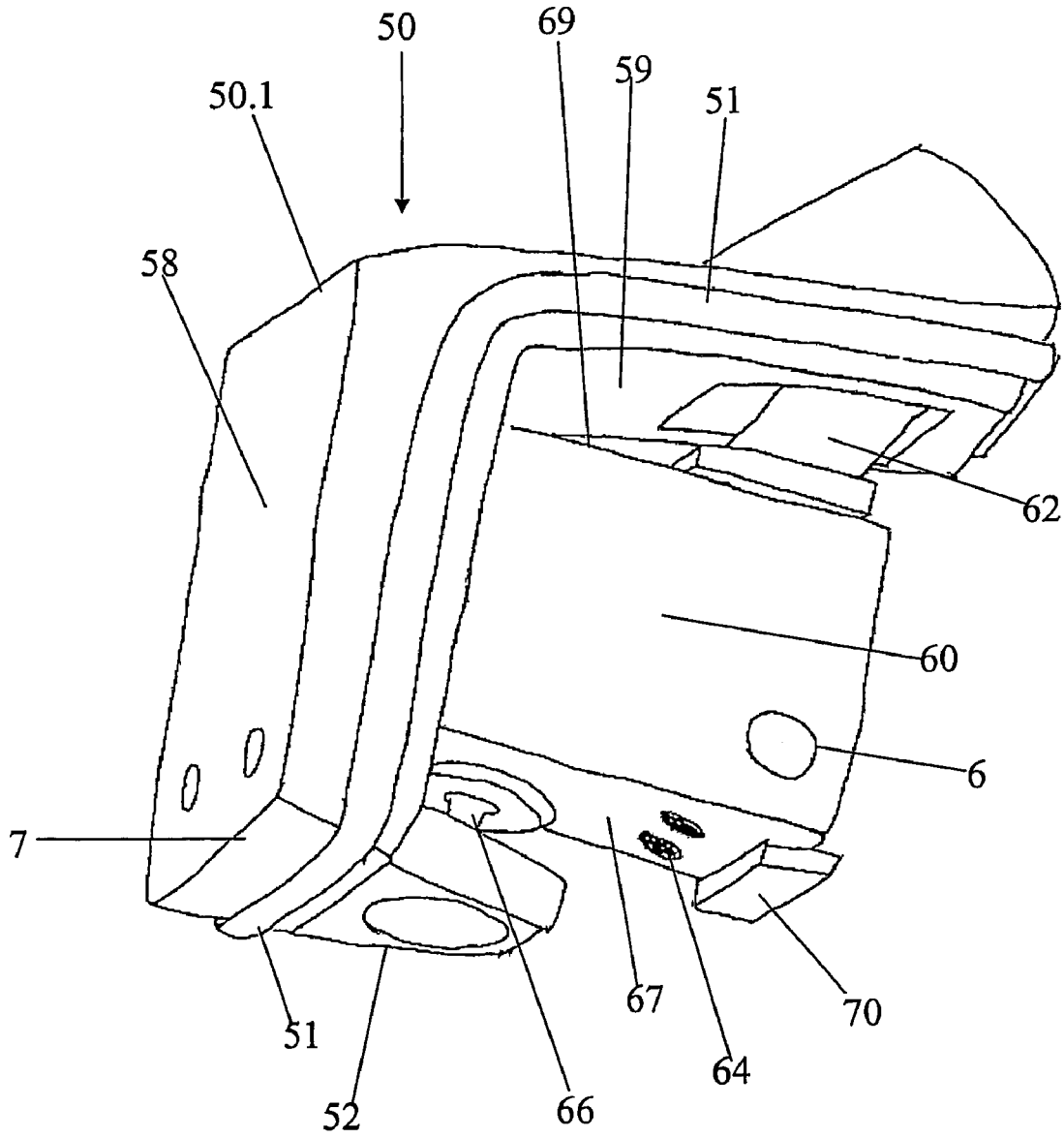
FIG. 2 shows the receiver assembly.
Figure 3:
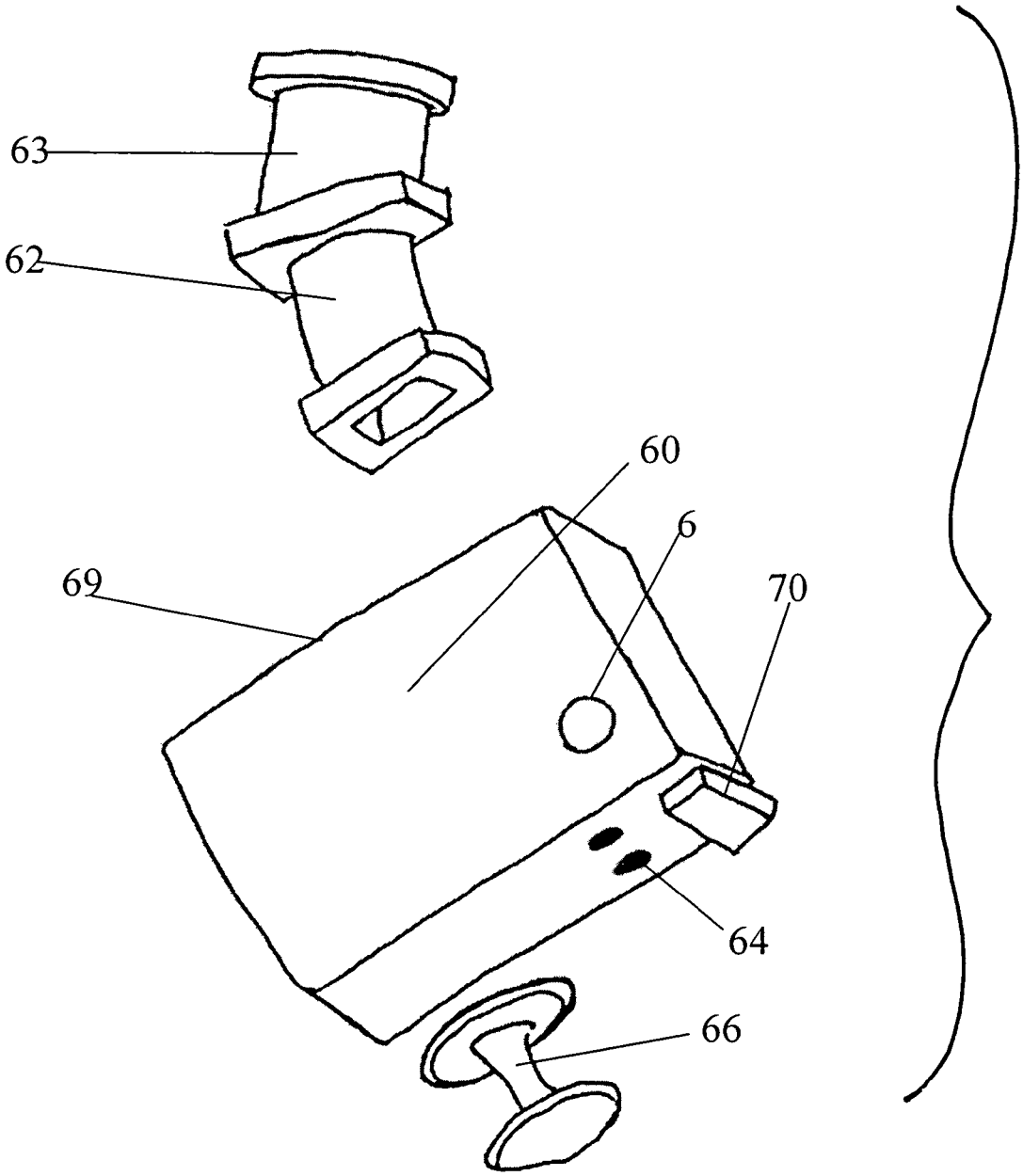
FIG. 3 shows an exploded view of the receiver with receiver suspension parts.

The receiver assembly 50 is described in more detail with respect to FIGS. 2 and 3. The receiver 60 has a sound outlet opening (not visible) in a first side and a flexible tube part 62 is coupled to the sound opening. The flexible tube 62 is shaped along with a tube 63 in order to form a combined sound outlet duct and receiver suspension part. At a side 67 the receiver has connection terminals 64 and also a further flexible suspension pole 66 is arranged at this side. The receiver assembly in FIG. 2 comprises the receiver 60 with suspensions 66, 62 and a receiver enclosure cover 50.1. This cover 50.1 has a first wall part 59 extending along the first side 69 of the receiver 60 and a second wall part 58 extending along a second side of the receiver 60. From the second wall part 58 a beam 52 extends along the third side 67 of the receiver 60. The first wall part 59 has means for receiving and holding the tube 63, and the beam 52 has means for receiving and holding the pole 66. When the receiver is assembled to the receiver enclosure cover 50.1, the receiver is suspended by the pole 66 and the flexible tube 62. Both the tube 63 and the pole 66 extend through respective openings in the wall part 59 and the beam 52 respectively. The flexible bellows part 62 and the pole 66 are both made of a flexible polymer, such that the suspended receiver 60 may move in any direction. This helps to absorb any vibrations coming from the receiver or coming from handling the hearing aid, such that the receiver is vibrationally isolated from the remaining hearing aid once assembled therewith.

As seen in FIGS. 2 and 3, a further shock absorbing means 70 is provided which prevents the receiver from bouncing on the internal walls of the enclosure.

In FIG. 1 it is shown how the receiver assembly may be placed in the bottom shell 1 of the hearing aid. The bottom shell comprises a bottom wall 2, two side walls 3,4 and a battery enclosure wall 5. These four walls, together with the two walls 58, 59 of the receiver enclosure cover 50.1 form a receiver cabinet which is completely isolated from the remainder of the interior of the hearing aid. In order to achieve a sound tight seal between the wall parts of the hearing aid and the receiver enclosure cover 50.1, the receiver enclosure cover 50.1 has a flexible sealing material 51 placed along the edges of the first and second wall parts 58, 59.

The electric connection to the receiver 60 is accomplished by use of flexible wires, which are soldered to the connection points 64 and connected to connection pins 65 embedded in the wall part 58.

Figure 4:
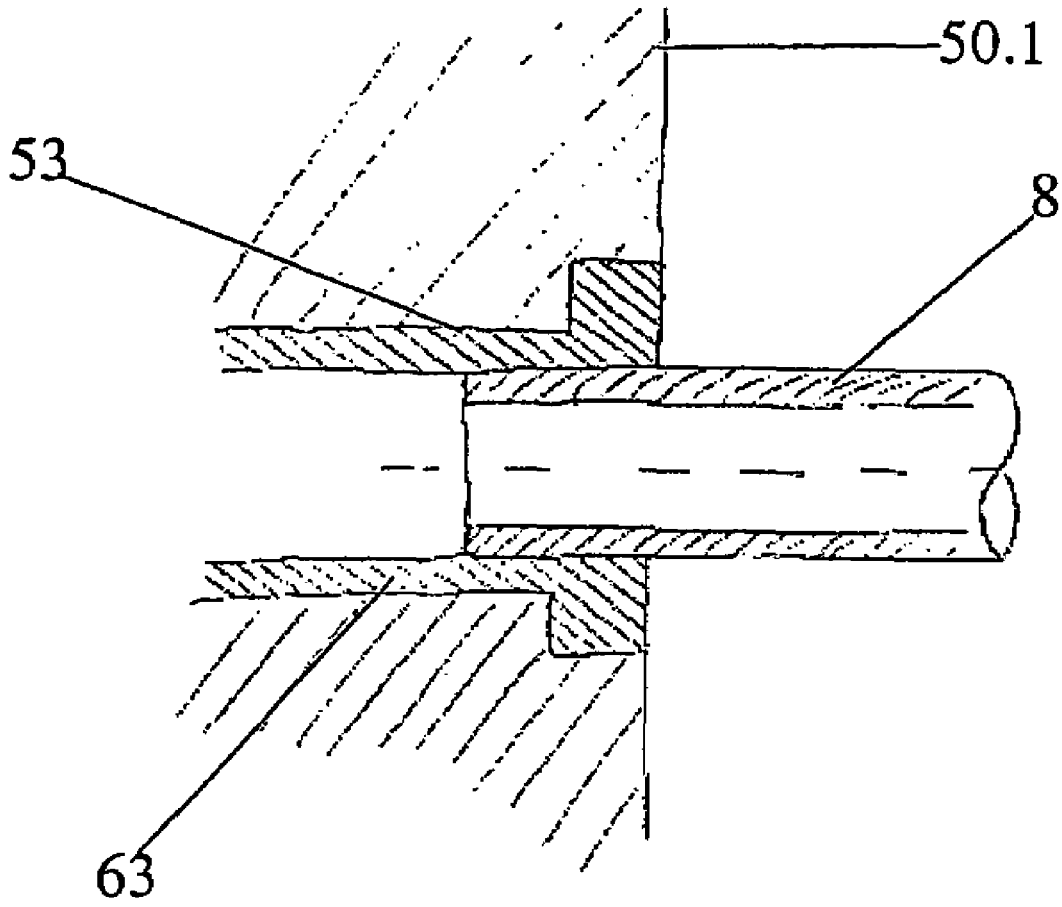
FIG. 4 is a cross section through the outlet from the receiver enclosure.

The hook 7 shown in FIG. 1 has a straight tube part 8 and a connection part 9. The straight tube part is to be inserted in the bottom shell 1 through an orifice and into the tube 63. In this way sound may be guided through tube 63, the straight tube part 8 and to the connection part 9. At the connection part 9 a flexible tube is to be connected to the hook in order to guide the sound to the ear of the user. As seen in FIG. 4 the receiver enclosure cover 50.1 has an opening 53, and the tube 63 is positioned inside this opening 53. The tube part 8 of the hook 9 is then placed inside the tube 63 and embraced by the inside surface of opening 53. In this manner it is ensured that sound cannot radiate from any radially extending surface of the tube 63, as no radial part thereof extend outside the opening 53. Both the receiver casing and the sound path to the ear of the user are then seeled acoustically off from the remainder of the hearing aid and no sound will leak to the microphones and cause feed-back even at high output levels of the receiver. The hermetic receiver enclosure also provides the possibility to use a vented receiver. Such a receiver uses the inside of the receiver inclosure described as part of the back volume with respect to the receiver membrane and this provides the possibility of a better receiver performance. A vent opening 6 is shown in the receiver wall.

The receiver 60 and the microphones 11, 12 are connected by usual electrical circuitry (not shown) which also comprises a signal processing unit (not shown) and a battery. In the present embodiment a front microphone 11 and a back microphone 12 are shown, but one, three or more microphones may be employed. The electrical circuitry gains connection with the connection pins 65 which are embedded in the wall part 58 of the receiver enclosure cover 50.1.

The top shell 20 has an edge outline which matches the top edges of side walls 3,4 of the bottom shell part 1. Along the edge outline of the top shell 20 a sealing material 21 is placed. This sealing material 21 is interrupted at places 23, 24 in order that the microphone inlets 13,14 of the microphones 11, 12 may gain access to the surrounding. As seen in FIG. 1 the microphones 11, 12 are placed symmetrically in the centre of the hearing aid and the microphone inlets 13, 14 are open to both sides of the hearing aid, and thus the interruptions 23, 24 in the sealing material 21 of the top shell 20 are provided at both sides to accommodate the microphone inlets. In this way both the top-shell 20 and the microphone inlets 13, 14 will have the same shape for both right and left side hearing aids. If desired, the microphone inlets pointing towards the user's head when the hearing aid is placed on the ear may be filled out with a plug of suitable material. This can happen at the production facility or at the final dispenser who sells the hearing aid to the end-user. Having the microphone inlets placed in the sealing line between the two shell parts has the further advantage that when the two shell parts are pressed together, a tight seal is obtained between the microphone inlets and the shell parts. This helps prevent the penetration into the hearing aid of contaminating substances such as sweat or dust which otherwise could damage the delicate electronic parts of the hearing aid. This further helps to prevent sounds generated by the receiver inside the hearing aid casing to leak into the sound inlet openings of the microphones. The two packing lines: the line between the two shell parts and the line between the receiver enclosure cover together assures, that no sound will leak from the receiver and through the air reach the microphones. Also, the placement of the microphone inlets in the packing material renders the microphone inlets less visible, which lends more possibilities for agreeable designs of the hearing aid.

It should be noted that the receiver suspension described in detail here serves the purpose of isolating the receiver from the remainder of the hearing aid with regards to mechanical vibration transmitted through the casing wall, and this is a necessary requirement if the full benefit of the sound isolation between receiver and microphone inlets is to be enjoyed.

Preferably, the sealing material at the sealing lines 51 and 21 are applied in a multi component injection moulding technique.

The receiver sub assembly 50 of FIG. 2 is produced and may easily be placed in the bottom shell 2 as seen from FIG. 1. The receiver sub assembly 50 may be held in place by suitable and well known click connections (not shown). Placement of the receiver 60 with suspensions 66, 62 in the receiver assembly cover 50.1 is done by drawing the tube 63 through the hole in the wall part 59 and likewise placing the pole 66 through the hole or slot in the beam 52. If the receiver should malfunction, it is easily exchanged. This is done simply by lifting the receiver assembly cover 50.1 out of the hearing aid and removing the connection wires from their connection points with the receiver. Thereafter, the receiver is easily removed from the receiver assembly cover, and a new receiver can be manually inserted to take its place. Soldering the connection wires to the new receiver is a formality.

Also the suggested positioning of the microphone inlets in the parting line between the two shell parts provides possibility of very simple microphone suspension. Also exchange of a microphone will be easy because the microphones are immediately accessible when the two parts of the hearing aid are taken apart. When the receiver is isolated from the rest of the hearing aid with respect to sound and vibration as described above it becomes possible to suspend the microphone without the use of flexible suspension means as is otherwise the usual practice. This simplifies the hearing aid as fewer components are necessary.

The invention claimed is:

1. A communication device comprising a casing enclosing a microphone and a signal processing means, wherein the casing comprises at least a bottom shell having a bottom wall and two side walls for positioning behind an ear of a user, a top shell which provides a cover, and a packing means provided between the top shell and the bottom shell, and wherein microphone orifices are provided between the top shell and the bottom shell which interrupt the packing means at respective opposed sides of the device, pointing towards and away from the user's head, and wherein the orifices enable sound to travel to a microphone inlet of a microphone placed symmetrically in a center of the device.

2. The communication device as claimed in claim 1, including two microphones, each having two orifices, such that each microphone has orifices at opposed sides of the device.

3. The communication device as claimed in claim 1, wherein the packing means is provided at a rim of one of the bottom shell and top shell by a multi-component injection technique.

* * * * *